United States Patent [19]

Czerwinski

[11] Patent Number: 4,992,789

[45] Date of Patent: Feb. 12, 1991

[54] MARINE LOCK AND ALARM APPARATUS

[76] Inventor: Daniel Czerwinski, 18442 S.W. 92 Ct., Miami, Fla. 33157

[21] Appl. No.: 436,451

[22] Filed: Oct. 31, 1989

[51] Int. Cl.[5] ..... G08B 13/06

[52] U.S. Cl. ..... 340/984; 340/568; 340/571; 340/652

[58] Field of Search ..... 340/984, 568, 571, 652, 340/428, 654

[56] References Cited

U.S. PATENT DOCUMENTS 3,824,540 7/1974 Smith, II ..... 340/571

3,898,641 8/1975 Banner ..... 340/568

*Primary Examiner*—Glen R. Swann, III

*Attorney, Agent, or Firm*—Malin, Haley, McHale, DiMaggio & Crosby

[57] ABSTRACT

A theft protection device which will protect either a docked boat or a parked boat mounted on a trailer includes a control box which houses electronic circuitry and batteries for energizing an audible alarm when the boat's battery cable or a cable connecting a lock box to an anchoring post is severed. The lock box completes an electronic circuit which is integrated with the electronic circuitry in the control box and includes a pair of shackles which receive a key operated lock which may be adjustably received on the shackles.

16 Claims, 3 Drawing Sheets

MARINE LOCK AND ALARM APPARATUS

BACKGROUND OF THE INVENTION

This invention relates to a theft protection device and more specifically to a theft protection device which, in one embodiment, is used on a boat which is docked at a pier or a slip. In its second embodiment, the theft protection device is used on a boat which is mounted on a trailer and parked ashore, whether it be on an empty lot, parking space or just about any place that one would park a boat and trailer when not in use. As we all know, theft in general, is a very serious problem in our country, and boats are no exception. Most docking areas are left unattended in the evening and even during daylight hours in some instances. Further, a boat on a trailer is very tempting to one involved in such illegal activities since it only takes a few seconds to attach the boat and trailer to the hitch of the thief's vehicle.

It was with this knowledge in mind that applicant was motivated to develop a theft alarm which can be used on either a docked boat or one mounted on its trailer.

In the recent past, some prior art theft alarms have been marketed which utilize the battery on the boat as the power source for operating an audible alarm. However, the alarm has been disabled by cutting the battery cable supplying current to the alarm. The instant invention has been designed with a dual alarm circuit i.e. initially the alarm is supplied with power from the boat's 12 volt battery. However, if the battery cable is cut, a second circuit utilizing a 9 volt battery will provide the necessary power to actuate the alarms in response to cutting of the battery cable.

SUMMARY OF THE INVENTION

The instant invention utilizes an electronic alarm which provides a primary alarm circuit and a secondary or back-up circuit.

In the event that the novel cable connection to the securing means is cut in an attempt to steal the boat or boat and trailer, an electrical circuit is completed within the theft control box and energizes an audible alarm which will alert persons in the area to the impending theft. Additionally, cutting the battery cable which is aboard the boat being protected will also sound the audible alarm. The circuitry of the instant invention, utilizing a back-up battery will provide the necessary power to detect that the battery cable from the boat's primary battery has been cut and sound the audible alarm.

OBJECTS OF THE INVENTION

An object of the invention is the provision of a boat theft prevention device.

Another object of the invention is the provision of a boat theft prevention device which is usable with a docked boat or a boat mounted on a trailer and parked in a parking space.

A further object of the invention is the provision of a boat theft prevention device which includes an audible alarm.

Yet another object of the invention is the provision of a boat theft protection device which uses the boat's battery as the primary source of electrical power.

A still further object of the invention is the provision of an electronic control circuit which is responsive to the cutting of the boat's battery cable.

An additional object of the invention is the provision of a boat theft protection device which is also responsive to the cutting of a padlock cable when secured ashore.

These and other objects of the instant invention will become more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
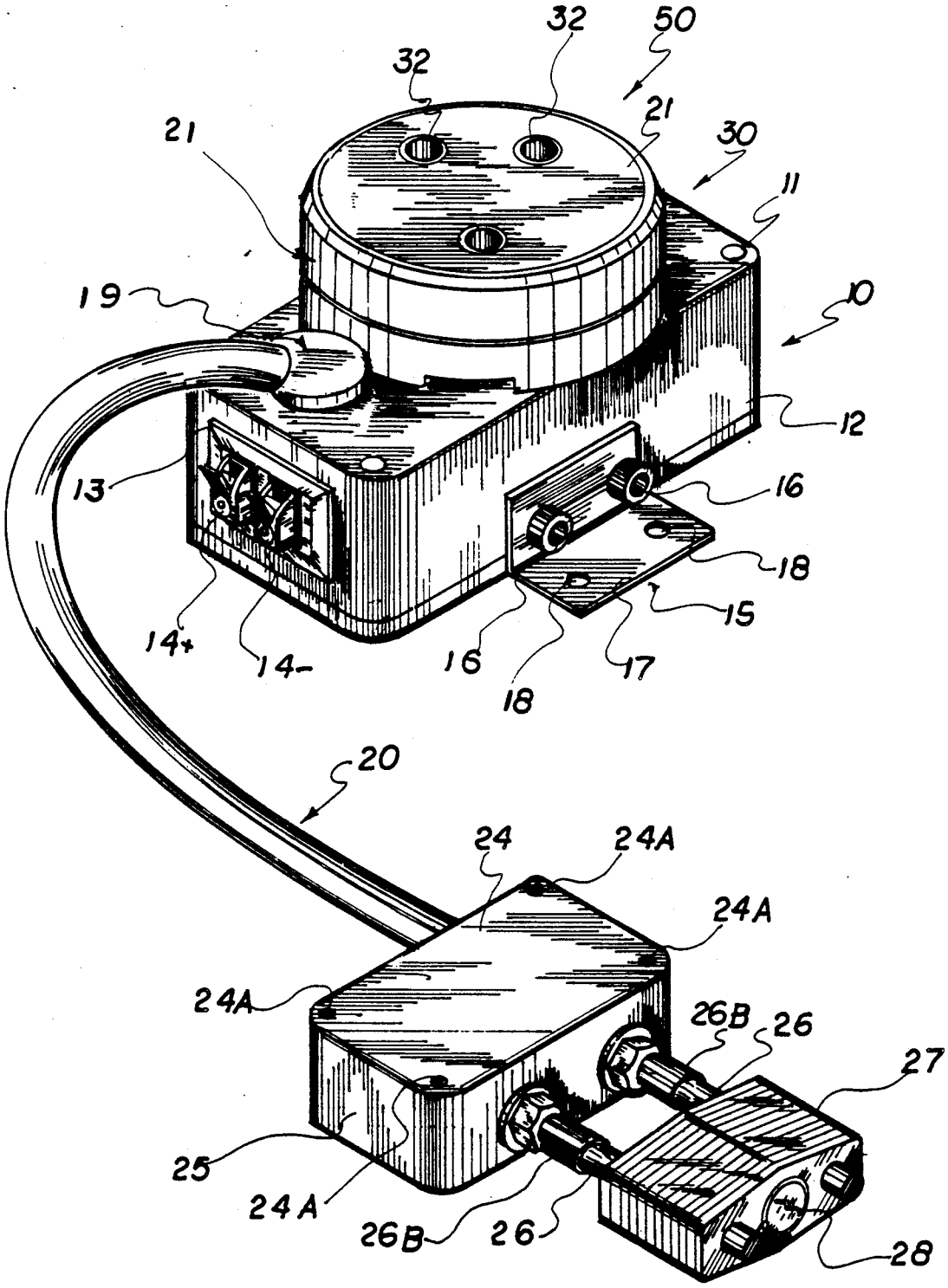
FIG. 1 is an illustration of the novel boat theft prevention device and its associated lock box.

Referring now to FIG. 1 there is shown an overall view of the novel theft prevention device indicated generally by reference numeral 50 which includes a rectangular control box 10 which houses the electronic circuitry and back-up battery which will be described in detail later with reference to FIG. 6. Mounted above cover 11 of the control box 10 is the audible alarm 30 which is fixedly attached thereto. As shown, cover 21 of alarm 30 is provided with a plurality of apertures 32 to permit the sound generated by alarm 30 to escape to the atmosphere. Side 12 of control box is shown as having angle bracket 15 secured thereto by a pair of Allen head bolts 16. Horizontal leg 17 is provided with a pair of mounting apertures 18 which are used to secure control box 10 to the boat by means of appropriate fasteners.

Figure 6:
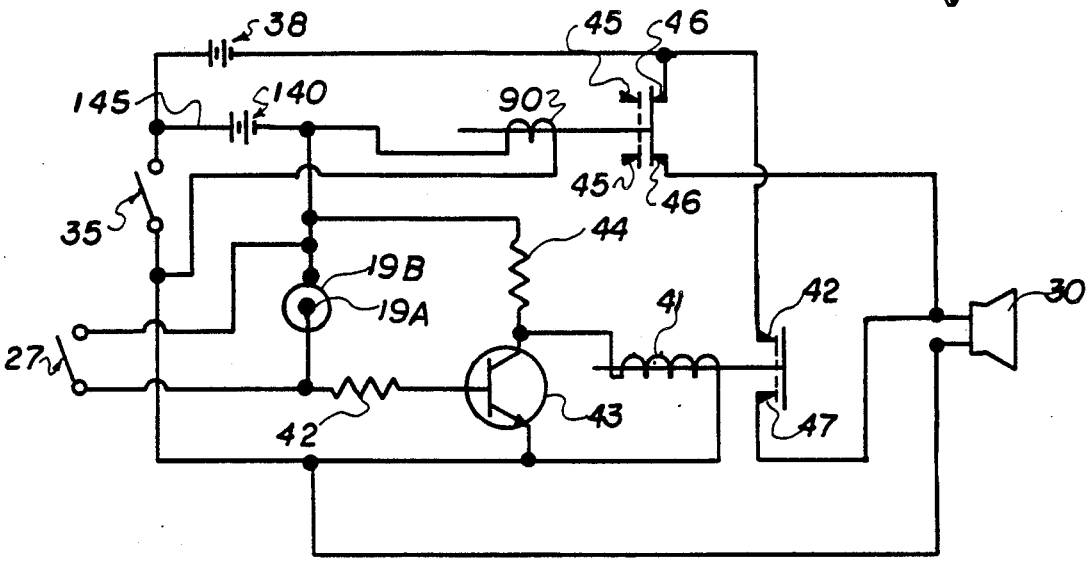
FIG. 6 is a schematic of the electrical circuitry used in the system.

Front face 13 of control box 10 is provided with a pair of electrical jacks 14+, 14− which receive the positive and negative cables from the boat's 12 volt battery (140 in FIG. 6). Extending upwardly from cover 11 is a phonograph-type plug 19 which, in the production units, will be a right angle plug to present a neater package. Although plug 19 is shown as entering control box 10 through cover 11, it could just as well enter through either side of control box 10.

Figure 5:
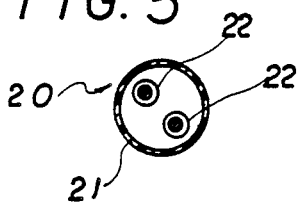
FIG. 5 is a sectional view taken along the lines 5—5 of FIG. 4.
Figure 4:
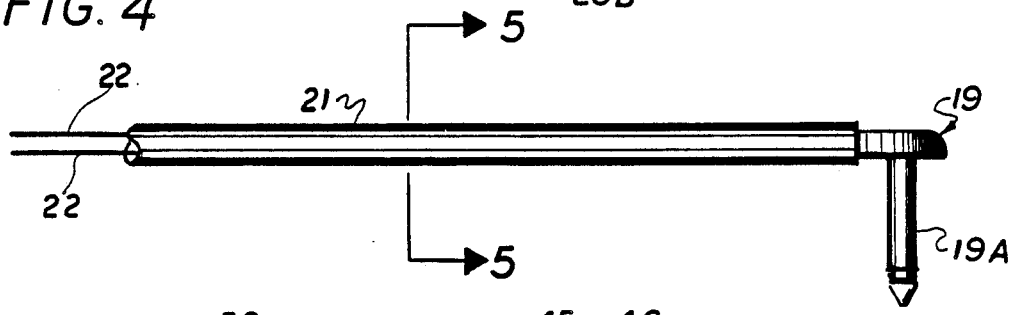
FIG. 4 is an illustration of the cable end which plugs into the control box.

Attached to the uppermost end of plug 19 is cable 20 which is provided with a one-quarter inch automotive fuel hose (S.A.E.) 21 and a pair of insulated conductors 22 therein as illustrated in FIGS. 4 and 5.

The other end of cable 20 is connected to lock-box 25 which has two notched shackles 26 extending from the side thereof. Lock 27 is received over the free ends of shackles 26 to complete the electrical circuit. Key slot 28 receives a key (not shown) for permitting removal of lock 27 from shackles 26.

Figure 2:
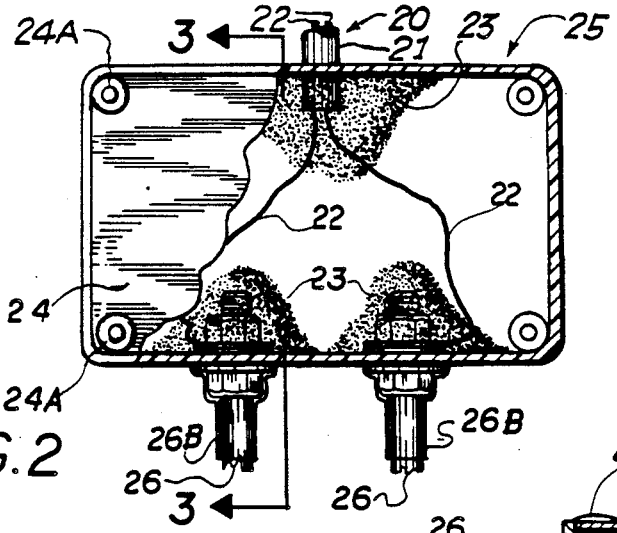
FIG. 2 is a partially open plan view of the lock box showing the internal connections.

Referring now to FIG. 2 there is shown a plan view of lock box 25 with its cover 24 partially removed to expose the interior thereof. A plurality of rivets 24A secure cover 24 to box 25. As illustrated, cable 20 is fixedly mounted to a side of lock box 25 and extends into the interior thereof. Within lock box 25, each of the individual conductors 22 is led to one of the shackles 26 and connected thereto at the inner ends thereof. The portion of cable 20 which extends into lock box 25 is encased with a mound of epoxy 23 to seal and help anchor cable 20 to lock box 25. Likewise, a mound of epoxy 23 is placed around each of the connections of conductors 22 to their respective shackles 26. Lock box 25 is made of plastic for its insulating and strength characteristics. After the connections to shackles 26 have been made the electrical circuit through conductors 22 is completed via lock 27 which is in contact with shackles 26 when mounted thereon (FIG. 1).

Figure 3:
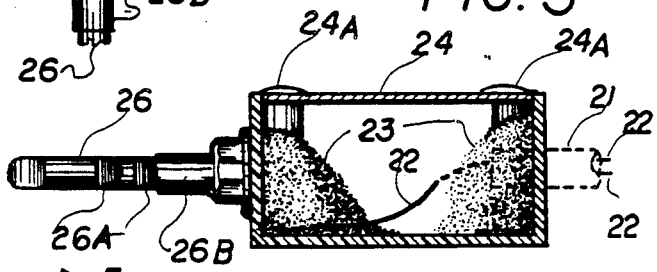
FIG. 3 is a sectional view taken on the line 3—3 of FIG. 2.

Referring now to FIG. 3, there is shown a sectional view taken along line 3—3 of FIG. 2. Here again, the mounds of epoxy 23 or potting compound are clearly shown. Shackle 26 is shown with a plurality of notches 26A for adjusting lock 27 thereon. This is considered to be an important feature since it permits a tight connection with a variety of anchoring sizes.

Turning now to FIG. 4, there is shown phonograph-type plug 19 with a forward portion 19A which is received in a female socket 19B (shown schematically in FIG. 6) within control box 10.

FIG. 5 is a sectional view taken along the line 5—5 of FIG. 4 illustrating the interior of cable 20 which contains a pair of conductors 22 covered by a one-quarter inch automotive fuel hose (S.A.E.) 21. The one-quarter inch automotive fuel hose (S.A.E.) provides protection against corrosion and other harmful effects of the elements.

Figure 7:
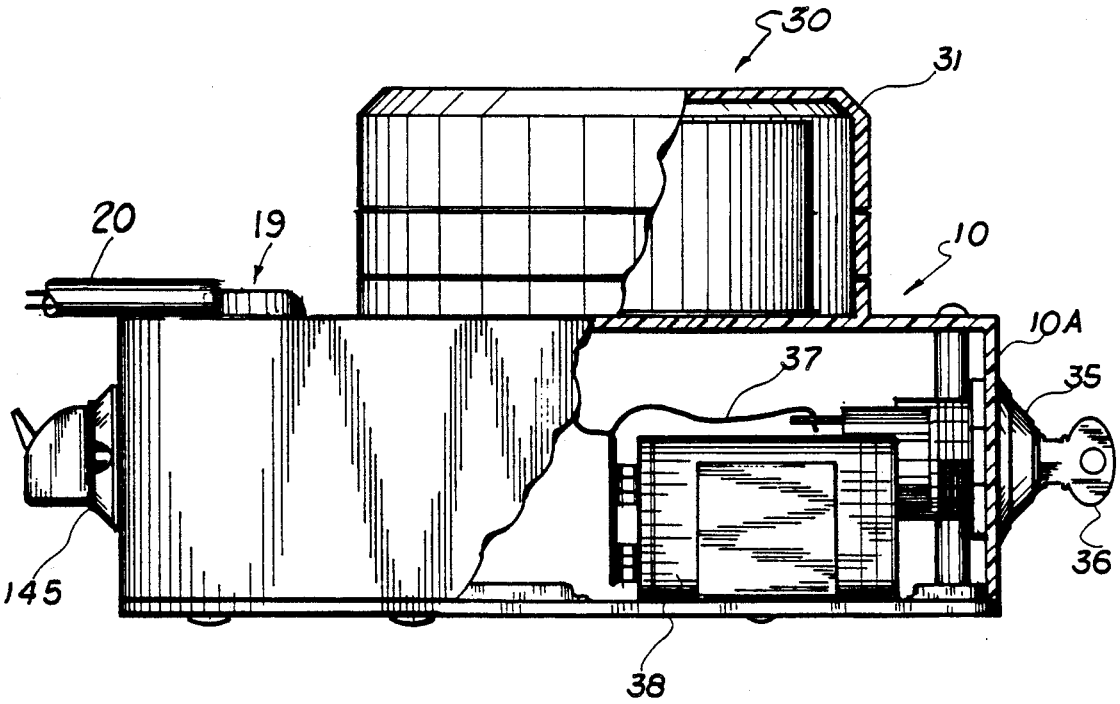
FIG. 7 is a side elevation view partially open illustration of some of the components in theft control box and the audible alarm.

Referring now to FIG. 6, there is shown the electronic circuitry which is contained within control box 10. As illustrated, arming switch 35 has not yet been activated by key 36 (FIG. 7). However, cable 20 has been secured to its anchoring screw 51 (FIG. 9) and lock 27 has been placed over shackles 26 to complete the circuit through cable 20.

As illustrated, the circuit includes one nine volt battery, 38 and also the boat's battery 140 which is a conventional twelve volt battery. Single pole double throw relay 90 is a 9–12 volt relay, while single pole single throw relay 41 is a 12 volt relay. Resistor 42, which is a 10,000 ohm resistor, is connected to the base of transistor 43 while resistor 44 is a 330 ohm resistor connected to the collector of transistor 43. Forward portion 19A of phonoplug 19 has been inserted into female socket 19B.

Once arming switch 35 is turned to the ON position the control circuit will become armed or energized. Relay 90 will be in its lower position as shown in dotted lines contacting contacts 45 and relay 41 will be in its open position, off contacts 47. Now, assuming a battery cable to the boat's 12 volt battery 140 has been cut in an attempt to disarm the theft prevention device 10, relay 90 will instantly move upward to the solid line position and engage contacts 46 thus connecting the 9 volt battery 38 to audible alarm 30 thereby sounding the alarm of impending theft.

Assuming now, that instead of cutting a battery cable, the person attempting the theft cuts cable 20 which is secured to anchoring screw 51 or cleat 68 (FIG. 10) the resistance to transistor 43 increases dramatically and shunts the power to relay 41 thus forcing it to close and make connection with contacts 47 to energize audible alarm 30. Therefore, it can be seen that the instant invention provides dual protection against theft by cutting the battery cable or anchoring cable 20.

Referring now to FIG. 7, there is shown a side elevational view of control box 10 with the side walls partially removed on control box 10 and audible alarm 30. The right rear wall 10A is provided with an arming switch 35 which includes key 36 for turning the alarm ON and OFF. With arming switch 10 in the OFF position, the alarm protection device is inactivated. Within the interior of control box 10, arming switch 35 is connected to lead 37 which is operatively connected to a nine volt battery 38. The remaining components within control box 10 are not visible, however, they have been clearly described above with respect to FIG. 6.

Figure 8:
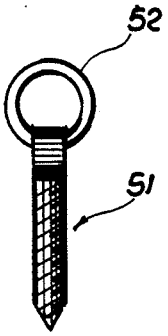
FIG. 8 is an illustration of the anchoring screw used with boat/trailer embodiment.

FIG. 8 is an illustration of the auger screw 51 which is used as the boat/trailer tie down. Auger screw 51 is screwed into the ground a sufficient distance to prevent easy removal and then one of the shackles 26 is passed through eye 52 followed by the placing of lock 27 over both shackles 26, thus securing the boat and trailer thereto. It must be remembered that cable 20 which extends from lock box 20 back to the control box 10 must be of sufficient length to reach that far. Accordingly, cable 20 would be available in a plurality of lengths or else custom made at the time of sale. Any appropriate ground anchoring means may be used as long as it has an eye for shackle 26.

Figure 9:
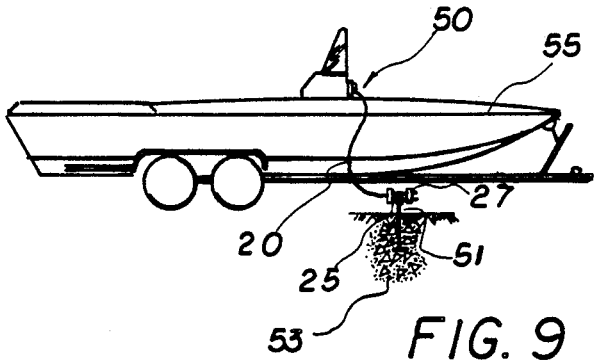
FIG. 9 is an illustration of the hook-up of the theft prevention device when used on a boat/trailer.

Referring to FIG. 9, there is an illustration of the theft protection device 50 securely fastened to boat 55. Cable 20 is illustrated extending to lock box 25 with one of the shackles 26 extending through the eye of auger screw 51 which extends into a concrete base 53 embedded in the soil and secured in place by lock 27.

Figure 10:
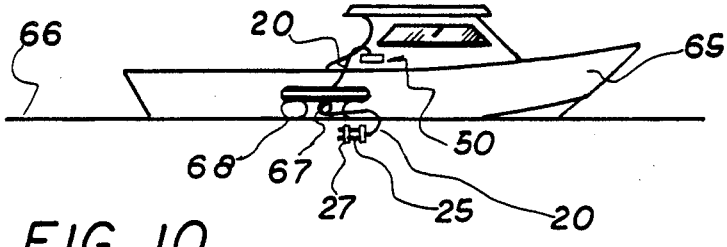
FIG. 10 is an illustration of the hook-up of the theft prevention device when used on a docked boat at a pier or slip.

FIG. 10 is an illustration of how theft protection device 50 is used with a boat 65 which is moored beside a dock 66. As illustrated, theft protection device 50 is securely mounted to a structural member of boat 65. Phonoplug 19 is passed through an aperture 67 in cleat 68 mounted to the dock, then inserted into female socket 19B within control box 10. Obviously lock 27 has been securely mounted on shackles 26. Due to the large size of lock box 25 relative to aperture 67 in cleat 68 cable 20 cannot be pulled through aperture 67.

While the invention has been described in its preferred embodiment, it is to be understood that the words which have been used are words of description rather than limitation and that changes may be made within the purview of the appended claims without departing from the full scope or spirit of the invention.

Having thus described my invention, I claim:

1. A theft prevention device for use with a boat which is either docked or securely mounted on a parked trailer, said boat having a twelve volt battery mounted therein; said theft prevention device comprising control box means and audible alarm means responsive to said control box means; said control box means housing electronic circuit means therein; said electronic circuit means comprising an electronic circuit means including activating means and electrical connection means to the twelve volt battery of the boat being protected, back-up battery means and normally open, energized relay means; whereby cutting a cable of said boat's battery de-energizes said relay means and comprises a circuit to said audible alarm means to sound an alarm indicating an attempted theft.

2. A theft prevention device of the character defined in claim 1 wherein said normally open, energized relay means includes a single pole double throw relay which is held in its open position by a coil when energized, and, when de-energized, is spring biased into its closed position when a cable of said boat's battery is severed to complete an electrical circuit to said audible alarm means.

3. A theft prevention device of the character defined in claim 2 wherein said back-up battery means is connected to a circuit which is completed when said single pole double throw relay is de-energized.

4. A theft prevention device of the character defined in claim 1 wherein said activating means comprises a manually operated key switch having an ON and OFF position, whereby placing said key switch in said ON position activates said electronic circuit means.

5. A theft prevention device of the character defined in claim 1 wherein said audible alarm means is a horn.

6. A theft prevention device of the character defined in claim 1 wherein said audible alarm means is a siren.

7. A theft prevention device of the character defined in claim 1 wherein said electrical connection means is a positive and negative connection from said boat's battery to said electronic circuit means.

8. A theft prevention device for use with a boat which is either docked or securely mounted on a parked trailer, said theft prevention device comprising control box means and audible alarm means responsive to said control box means; said control box means housing electronic circuit means therein; said electronic circuit means comprising an electronic circuit including a manually activated switch, theft preventing cable means operably connected to said electronic circuit, said theft preventing cable means being a cable having a first end and a second end, said first end of said cable being securely attached to said boat, said cable containing at least one pair of electrically conducting wires, said electrically conducting wires being electrically connected at said first end of said cable to said electronic circuit and electrically connected at said second end of said cable through means, attached to said second end, for securing said second end of said cable to a secure object of the user's choice, said electrically conducting wires thereby forming a continuous circuit loop through said means for securing said second end of said cable to a secure object so that the electrical properties of said secure object are not incorporated into said continuous circuit loop whereby cutting said cable or removing said means for securing said second end of said cable from said cable interrupts the electrical continuity of said electrically conducting wires in said cable, and, means for activating said audible alarm means in response to an interruption of the electrical continuity of said electrically conducting wires in said cable.

9. A theft protection device of the character defined in claim 8 wherein said electrical connection between said electrically conducting wires and said first end of said cable comprises a plug operationally connected to said electronic circuit.

10. A theft prevention device of the character defined in claim 9 wherein said cable means includes a flexible fuel hose within which said electrically conducting wires are positioned, said electrically conducting wires having a covering of electrically insulating material.

11. A theft prevention device of the character defined in claim 8 wherein said means for securing said second end of said cable to a secure object comprises lock box means with shackle means electrically connected to said electrically conducting wires, said shackle means extending outwardly from said lock box means and receiving a releasable lock whereby the electrical continuity of said electrically conducting wires is maintained through the interaction of said shackle means and said releasable lock.

12. A theft prevention device of the character defined in claim 11 wherein said shackle means includes adjustment means for permitting engagement with different sized anchoring means, said anchoring means securely attached to said secure object of the user's choice.

13. A theft prevention device of the character defined in claim 12 wherein said anchoring means comprises an auger screw which is securely inserted into the ground; said auger screw having an eye portion at the uppermost end thereof for receiving said shackle means prior to its engagement with said releasable lock.

14. A theft prevention device of the character defined in claim 12 wherein said anchoring means comprises a cleat; said cleat having an aperture therein whereby said second end of said cable means, including said shackle means, may pass therethrough prior to receiving said releasable lock, said releasable lock being larger than said aperture thereby precluding the travel of said releasable lock through said aperture thereby securing said cable means to said cleat.

15. A theft prevention device of the character defined in claim 8 wherein said audible alarm means comprises a horn.

16. A theft prevention device of the character defined in claim 8 wherein said audible alarm means comprises a siren.

* * * * *